US007903039B2

(12) United States Patent
Yu

(10) Patent No.: US 7,903,039 B2
(45) Date of Patent: Mar. 8, 2011

(54) BROADBAND MULTI-LOOP ANTENNA FOR MOBILE COMMUNICATION DEVICE

(75) Inventor: Wei Yu, Shenzhen (CN)

(73) Assignee: Shenzhen Sunway Communication Co., Ltd., Shenzhen (CN)

( * ) Notice: Subject to any disclaimer, the term of this patent is extended or adjusted under 35 U.S.C. 154(b) by 253 days.

(21) Appl. No.: 11/721,336

(22) PCT Filed: Feb. 5, 2005

(86) PCT No.: PCT/CN2005/000163

§ 371 (c)(1),
(2), (4) Date: Apr. 28, 2009

(87) PCT Pub. No.: WO2006/081704

PCT Pub. Date: Aug. 10, 2006

(65) Prior Publication Data

US 2010/0134366 A1 Jun. 3, 2010

(51) Int. Cl.
*H01Q 11/12* (2006.01)

(52) U.S. Cl. ..... 343/742; 343/702; 343/867

(58) Field of Classification Search ..... 343/700 MS, 343/702, 742, 867
See application file for complete search history.

(56) References Cited

U.S. PATENT DOCUMENTS

| | | | | |
|---|---|---|---|---|
| 6,166,694 | A * | 12/2000 | Ying | 343/702 |
| 6,552,686 | B2 * | 4/2003 | Ollikainen et al. | 343/700 MS |
| 7,102,575 | B2 * | 9/2006 | Pan | 343/702 |
| 7,768,468 | B2 * | 8/2010 | Gustafson et al. | 343/750 |
| 2010/0085268 | A1 * | 4/2010 | Yeh et al. | 343/803 |

* cited by examiner

*Primary Examiner* — Tan Ho

(57) ABSTRACT

A broadband multi-signal loop antenna in a mobile communication device such as a cellular phone having a chassis is disclosed. The antenna includes a conductor assembly electrically connected to the chassis and including a plurality of loops each starting at a common feed point and ending at respective grounding point; and a member for mounting the conductor assembly thereon. The loop has a grounding point. The ground points are located at different physical positions. The antenna is adapted to operate at multi-band.

14 Claims, 8 Drawing Sheets

BROADBAND MULTI-LOOP ANTENNA FOR MOBILE COMMUNICATION DEVICE

BACKGROUND OF THE INVENTION

1. Field of Invention

The invention relates to antenna for hand-held telecommunication devices and more particularly to a broadband multi-loop antenna mounted in a mobile communication device (e.g., cellular phone).

2. Description of Related Art

The development trend of antenna for a hand-held telecommunication device (e.g., cellular phone) is an antenna capable of operating in multi-band (e.g., GSM 800/900/1800/1900 Hz, and/or WLAN 2.4 GHz/5.1 GHz/5.8 GHz), being high in gain, and working well in one of a plurality of states of the cellular phone (e.g., folding, open, hand-held, waist hanging, or resting upon a desk). Moreover, antennas for cellular phone are typically mounted therein (i.e., internal antennas) for purposes including aesthetics, durability, portability, etc. Such internal antenna is typically capable of operating in dual-band (i.e., GSM 900 Hz and GSM 1800 Hz; GSM 850 Hz and GSM 1900 Hz); or tri-band (i.e., GSM 900 Hz, GSM 1800 Hz and GSM 1900 Hz; or GSM 850 Hz, GSM 1800 Hz and GSM 1900 Hz). It is desired by the cellular phone manufacturers to produce a cellular phone having an antenna capable of operating in four different bands so as to reduce the manufacturing cost, be more competitive in the market, and have other beneficial advantages.

United States Patent Application Number 2004/0075610 discloses a PIFA antenna apparatus for mobile communications terminals as shown in FIG. 1A. The PIFA antenna comprises an HF input/output and two antenna surfaces respectively having a connecting point to the ground plane of a mobile communication terminal. The first antenna surface is configured for two independent frequencies and the second antenna surface 1000 is configured for a third independent frequency. Only the first antenna surface is connected to the HF input/output and the second antenna surface is arranged in a non-contact manner with respect to the first antenna surface, whereby an electromagnetic coupling occurs between both antenna surfaces.

United States Patent Application Number 2003/0052824 discloses an internal multi-band antenna with improved radiation efficiency as shown in FIG. 1B in which a third radiating element 1000 is provided for effecting multi-band operation.

Another conventional proposal for effecting a multi-band antenna is characterized by increasing the number of loops as shown in FIG. 1C. However, grounding points 1 and 2 are common for a plurality of loops. Thus, it is low in performance.

All of the above prior art failed to effect an antenna capable of operating in quad-band. Thus, the need for innovative improvement still exists.

SUMMARY OF THE INVENTION

It is therefore one object of the invention to provide a broadband multi-loop antenna mountable in a mobile communication device having a chassis, comprising a conductor assembly electrically connected to the chassis and including a plurality of loops each starting at a common feed point and ending at respective grounding points; and a mounting member for mounting the conductor assembly thereon.

In a first aspect of the invention at least one of the loops comprises at least one conductive branch having one end connected to a predetermined location of the loop other than the grounding point of the loop and the other end open.

In a second aspect of the invention a length from the feed point of the loop to the grounding point thereof is longer than 20 mm.

In a third aspect of the invention the loops comprise a first loop and a second loop, and the first and the second loops have a common conductor.

In a fourth aspect of the invention the loops comprise a first loop, a second loop, and a third loop, and the first, the second, and the third loops have a common conductor.

In a fifth aspect of the invention the first loop is either completely surrounded by the second loop or partially surrounded by the second loop, or the first loop and the second loop are located at each side of the common conductor.

In a sixth aspect of the invention the first loop comprises at least one conductive branch and the second loop comprises at least one conductive branch, each of the conductive branches has a length in a range of about 0.1 mm to about 80 mm, a length from a connecting point of the conductive branch and the loop to an end of the feed point is about 10% to 90% of a total length of the first loop, and a length from a connecting point of the conductive branch and the loop to an end of the feed point is about 10% to 90% of a total length of the second loop.

In a seventh aspect of the invention further comprises a conductive connection for interconnecting portions of the first loop and the second loop other than the common conductor.

In an eighth aspect of the invention further comprises a conductive connection for interconnecting the first loop and the second loop.

In a ninth aspect of the invention the first loop comprises a conductive branch, the second loop comprises a conductive branch, and the third loop comprises a conductive branch, each of the conductive branches has a length in a range of about 0.1 mm to about 80 mm, a length from a connecting point of the conductive branch and the loop to an end of the feed point is about 10% to 90% of a total length of the first loop, a length from a connecting point of the conductive branch and the loop to an end of the feed point is about 10% to 90% of a total length of the second loop, and a length from a connecting point of the conductive branch and the loop to an end of the feed point is about 10% to 90% of a total length of the third loop.

In a tenth aspect of the invention at least one of the first, the second, and the third loops comprises two conductive branches, at least one of the first, the second, and the third loops comprises a conductive branch, each of the conductive branches has a length in a range of about 0.1 mm to about 80 mm, a length from a connecting point of the conductive branch and each of the first, the second, and the third loops to an end of the feed point is about 10% to 90% of a total length of each of the first, the second, and the third loops.

In an eleventh aspect of the invention further comprises a first conductive connection for interconnecting portions of the first loop and the second loop other than the common conductor, and a second conductive connection for interconnecting portions of the second loop and the third loop other than the common conductor.

In a twelfth aspect of the invention further comprises a first conductive connection for interconnecting the first loop and the second loop, and a second conductive connection for interconnecting the second loop and the third loop.

In a thirteenth aspect of the invention a projection of the antenna relative to a normal of the chassis is completely out of the projection of the chassis.

In a fourteenth aspect of the invention a projection of the antenna relative to a normal of the chassis is either completely within the projection of the chassis or partially within the projection of the chassis, and further comprises a recess on a ground plane of the chassis at the projection superposition portion of the antenna and the chassis.

In a fifteenth aspect of the invention each of the first and the second loops has a shape of a zigzag line, a curve line, a tooth-shaped line, a line having a width gradually increased, or a hollow line.

In a sixteenth aspect of the invention each of the first, the second, and the third loops has a shape of a zigzag line, a curve line, a tooth-shaped line, a line having a width gradually increased, or a hollow line.

In a seventeenth aspect of the invention the loops comprise a first loop, a second loop, a third loop, and a fourth loop, and each of the first, the second, the third, and the fourth loops has a grounding point and a conductive branch.

In an eighteenth aspect of the invention the loops comprise a first loop, a second loop, a third loop, and a fourth loop, each of the first and the second loops has a common grounding point, and each of the first, the second, and the fourth loops has a conductive branch.

The above and other objects, features and advantages of the invention will become apparent from the following detailed description taken with the accompanying drawings.

BRIEF DESCRIPTION OF THE DRAWINGS

FIG. 15A where a grid structure is formed at the ground plane as a variation of the antenna shown in FIG. 15A;

DETAILED DESCRIPTION OF THE INVENTION

Term Definitions

"Feed point" means a connecting point of an antenna and a chassis of a mobile communication device. That is, a point of radio frequency (RF) input and output of the chassis. The feed point is a starting point of a loop of the invention.

"Grounding point" means a physical connecting point of the antenna and a ground plane of the chassis of a mobile communication device (e.g., cellular phone), that is, at an end of the loop of the invention. The grounding point is electrically connected to a grounding point of the feed point so as to form a loop. There are a plurality of grounding points at different physical locations electrically connected to a conductor (i.e., ground plane) according to the invention.

"Loop" means a conductive loop starts at the feed point and terminates at one of the grounding points.

"Relations between the loops including completely surrounding and partially surrounding" means location relationships between the loops after spreading the loops on a plane.

Figure 1A:
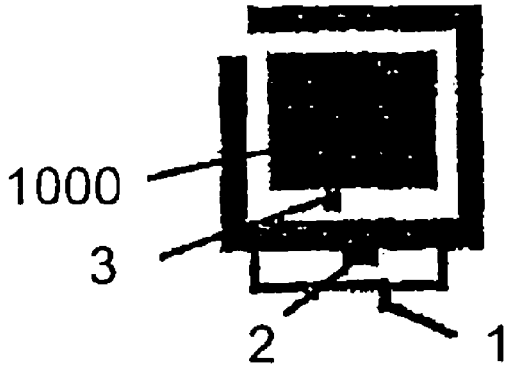
FIG. 1A PRIOR ART
FIG. 1A is a schematic top view of a PIFA antenna according to United States Patent Application Number 2004/0075610.
Figure 1B:
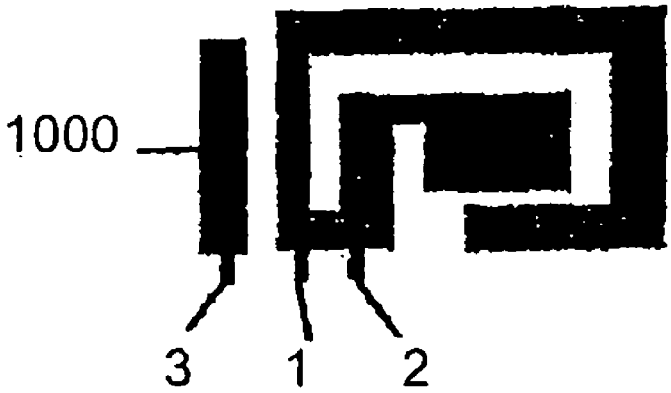
FIG. 1B PRIOR ART
FIG. 1B is a schematic top view of an internal multi-band antenna according to United States Patent Application Number 2003/0052824.
Figure 1C:
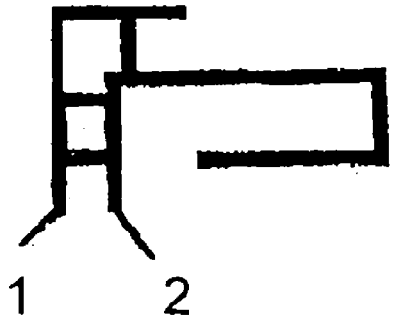
FIG. 1C PRIOR ART
FIG. 1C is a schematic top view of a conventional multi-band antenna.
Figure 2A:
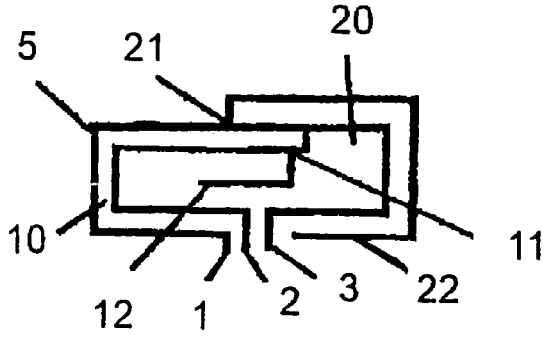
FIG. 2A is a schematic top view of a first preferred embodiment of broadband multi-loop antenna for use in a mobile communication device according to the invention.
Figure 2B:
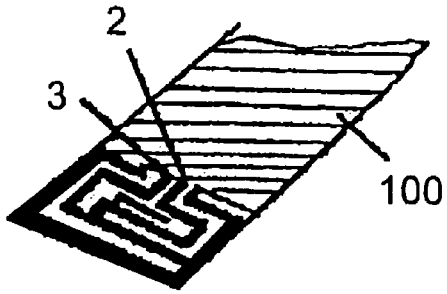
FIG. 2B is a perspective view of the antenna of FIG. 2A mounted on a chassis of the mobile communication device.
Figure 2C:
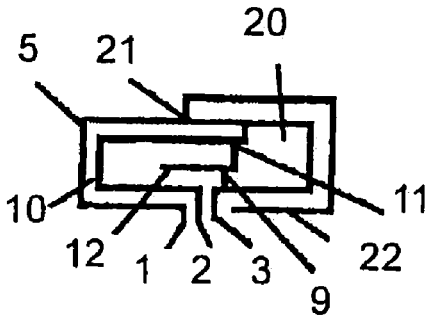
FIG. 2C is a schematic top view of the antenna of FIG. 2A where portions of two loops other than common conductor are connected together by a conductive connection.

Referring to FIGS. 2A and 2B, a broadband multi-loop antenna for mobile communication device in accordance with the invention comprises conductors (indicated by bold lines) and a mounting member for mounting the conductors thereon. The mounting member can be an FPC (flexible printed circuit board), a PCB (printed circuit board), a plastic member, a housing of a mobile communication device, etc. The conductor can be a copper membrane, a plated or printed metal, etc. These are well known in the art and a detailed description thereof is therefore deemed unnecessary.

As shown in FIG. 2B, the conductor is electrically connected to a chassis 100 of a mobile communication device. The chassis 100 is the main-board of the mobile communication device and is formed thereon with transmission circuits, receiving circuits, and control circuits by printing.

Referring to FIG. 2A, a first preferred embodiment of the invention is shown. The conductor comprises a first loop 10 and a second loop 20. The loops 10 and 20 starts at a common feed point 1 and ends at grounding points 2 and 3 respectively. The first and second loops 10 and 20 have a common conductor 5 having a length in a range of 0.001 mm to 80 mm.

Figure 3:
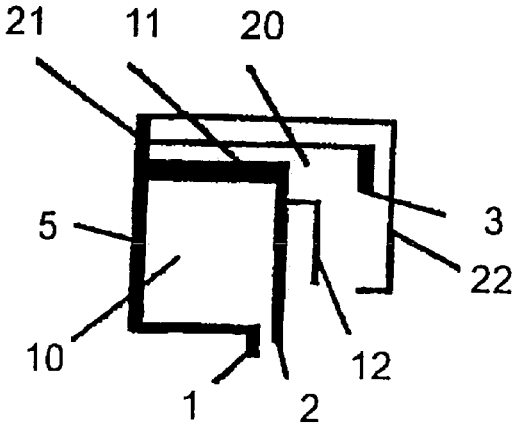
FIG. 3 is a schematic top view of a second preferred embodiment of broadband multi-loop antenna for use in a mobile communication device according to the invention.

Referring to FIG. 3, a second preferred embodiment of the invention is shown. The conductor comprises a first loop 10 and a second loop 20. It is shown that both the first loop 10 and the second loop 20 are located on the same side of the common conductor 5.

Figure 4:
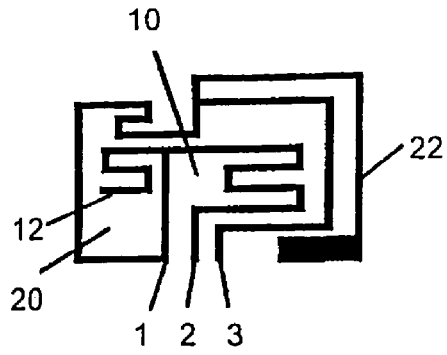
FIG. 4 is a schematic top view of a third preferred embodiment of broadband multi-loop antenna for use in a mobile communication device according to the invention where first and second loops have no common part other than common feed point, each loop has a conductive branch, and first and second loops are located on the same side of the common feed point.

Referring to FIG. 4, a third preferred embodiment of the invention is shown. The third embodiment is identical to the first embodiment, except that the common feed point 1 is the only common part of the first loop 10 and the second loop 20 and both the grounding point 2 of the first loop 10 and the grounding point 3 of the second loop 20 are located on the same side of the common feed point 1.

Figure 5:
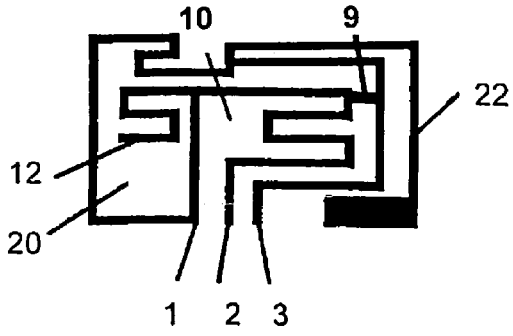
FIG. 5 is a schematic top view of a fourth preferred embodiment of broadband multi-loop antenna for use in a mobile communication device according to the invention where first and second loops have no common part other than common feed point, each loop has a conductive branch, first and second loops are located on the same side of the common feed point, and a conductive connection is interconnected the first and second loops.

Referring to FIG. 5, a fourth preferred embodiment of the invention is shown. The third embodiment is identical to the third embodiment, except that a conductive connection 9 is employed to interconnect the first loop 10 and the second loop 20. In each of the above embodiments, bands for the loops 10 and 20 are different each other due to their different location relationships. Thus, the antenna of the invention can be implemented in different applications.

Referring to FIGS. 3 to 5 in conjunction with FIG. 2A, the first loop 10 comprises a conductive branch 12 and the second loop 20 comprises a conductive branch 22 respectively. Each of the conductive branches 12 and 22 has a length about 0.1 mm to about 80 mm. A length from a connecting point 11 of the conductive branch 12 and the first loop 10 to the end of the feed point 1 is about 10% to 90% of the total length of the first loop 10 and a length from a connecting point 21 of the conductive branch 22 and the second loop 20 to the end of the feed point 1 is about 10% to 90% of the total length of the second loop 20 respectively.

Figure 6:
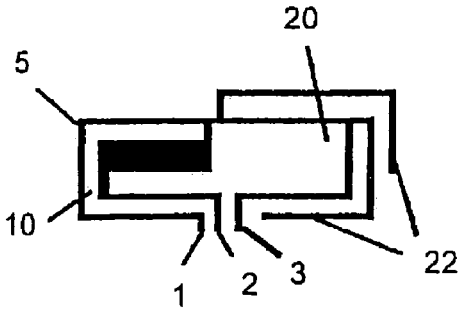
FIG. 6 is a schematic top view of a fifth preferred embodiment of broadband multi-loop antenna for use in a mobile communication device according to the invention.

Referring to FIG. 6, a fifth preferred embodiment of the invention is shown. The characteristics of the fifth preferred embodiment are detailed below. The first loop 10 does not have any conductive branches. The second loop 20 has two conductive branches 22.

Figure 7:
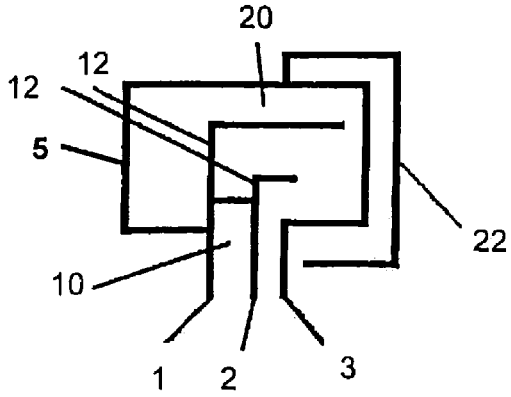
FIG. 7 is a schematic top view of a sixth preferred embodiment of broadband multi-loop antenna for use in a mobile communication device according to the invention.

Referring to FIG. 7, a sixth preferred embodiment of the invention is shown. The characteristics of the sixth preferred embodiment are detailed below. The first loop 10 has two conductive branches 12 and the second loop 20 has a conductive branch 22. Also, both the grounding point 2 of the first loop 10 and the grounding point 3 of the second loop 20 are located on the same side of the common feed point 1 or the common conductor 5.

It is possible of forming additional loops by shorting the loops with a conductive connection. For example, in the fourth preferred embodiment, a conductive connection 9 is employed to interconnect the first loop 10 and the second loop 20 as shown in FIG. 5.

Figure 8A:
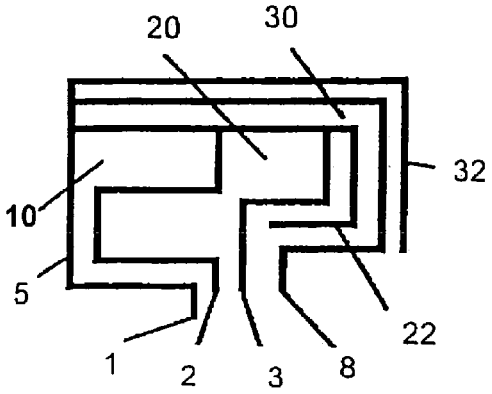
FIG. 8A is a schematic top view of a seventh preferred embodiment of broadband multi-loop antenna for use in a mobile communication device according to the invention.
Figure 8B:
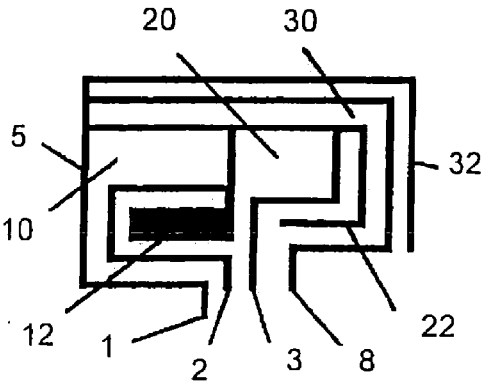
FIG. 8B is a first configuration of the antenna of FIG. 8A where each loop has a conductive branch.

Referring to FIG. 8A, a seventh preferred embodiment of the invention is shown. The conductor comprises a first loop 10, a second loop 20 and a third loop 30. The loops 10, 20 and 30 start at a common feed point 1 and end at grounding points 2, 3 and 8 respectively. The first, second and third loops 10, 20 and 30 have a common conductor 5. The first loop 10 does not have any conductive branches. The second loop 20 comprises a conductive branch 22 and the third loop 30 comprises a conductive branch 32 respectively. FIG. 8B shows a first configuration of the antenna of FIG. 8A where each of the loops 10, 20 and 30 has a conductive branch 12, 22, or 32.

Figure 9:
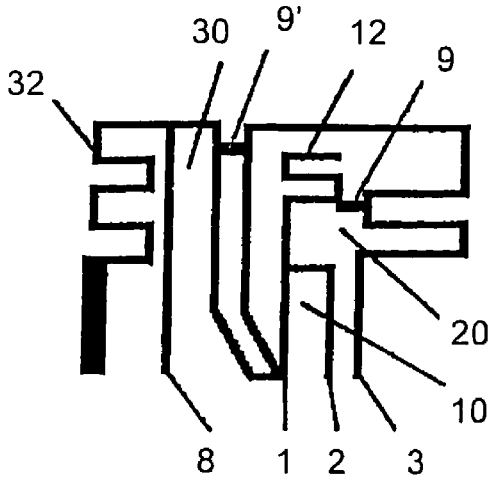
FIG. 9 is a schematic top view of an eighth preferred embodiment of broadband multi-loop antenna for use in a mobile communication device according to the invention.

Referring to FIG. 9, an eighth preferred embodiment of the invention is shown. The conductor comprises a first loop 10, a second loop 20 and a third loop 30. The characteristics of the eighth preferred embodiment are detailed below. The common feed point 1 is the only common part of the loops 10, 20 and 30. Each of the loops 10, 20 and 30 ends at grounding points 2, 3 and 8 respectively. The first loop 10 comprises a conductive branch 12 and the third loop 30 comprises a conductive branch 32 respectively. Alternatively, one or two of the loops 10, 20 and 30 has (or have) two conductive branches and the remaining loops have a conductive branch. Each of the conductive branches 12, 22 and 32 has a length about 0.1 mm to about 80 mm. A length from a connecting point 11 of the conductive branch 12 and the first loop 10 to the end of the feed point 1 is about 10% to 90% of the total length of the first loop 10, a length from a connecting point 21 of the conductive branch 22 and the second loop 20 to the end of the feed point 1 is about 10% to 90% of the total length of the second loop 20, and a length from a connecting point 31 of the conductive branch 32 and the third loop 30 to the end of the feed point 1 is about 10% to 90% of the total length of the third loop 30 respectively.

Figure 8C:
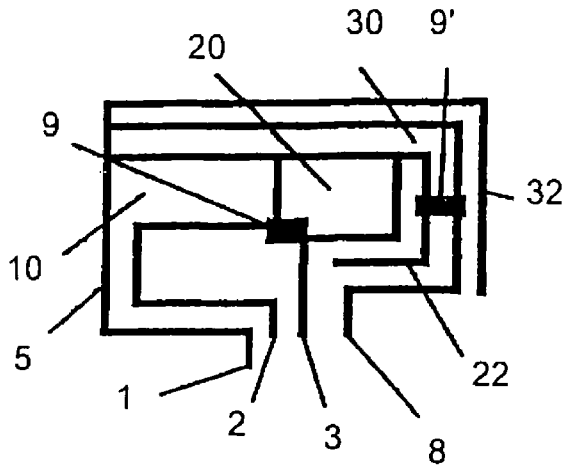
FIG. 8C is a second configuration of the antenna of FIG. 8A where a conductive connection is interconnected the first and second loops and another conductive connection is interconnected the second and third loops respectively.

Referring to FIG. 8C, a second configuration of the antenna of FIG. 8A is shown. A conductive connection 9 is employed to interconnect portions of the first loop 10 and the second loop 20 other than the common conductor 5. A conductive connection 9' is employed to interconnect portions of the second loop 20 and the third loop 30 other than the common conductor 5.

Likewise, as shown in FIG. 9, a conductive connection 9 is employed to interconnect the first loop 10 and the second loop 20. A conductive connection 9' is employed to interconnect the second loop 20 and the third loop 30. Alternatively, a plurality of conductive connections are employed to interconnect two loops.

Figure 10:
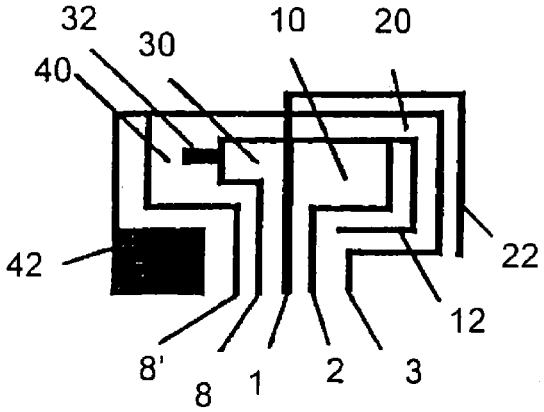
FIG. 10 is a schematic top view of a ninth preferred embodiment of broadband multi-loop antenna for use in a mobile communication device according to the invention.

Referring to FIG. 10, a ninth preferred embodiment of the invention is shown. The conductor comprises a first loop 10, a second loop 20, a third loop 30, and a fourth loop 40. The characteristics of the ninth preferred embodiment are detailed below. Each of the loops 10, 20, 30, and 40 has a grounding point 2, 3, 8, or 8' and a conductive branch 12, 22, 32, or 42.

Figure 11:
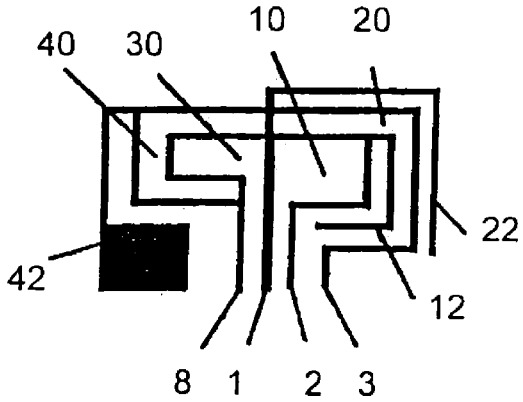
FIG. 11 is a schematic top view of a tenth preferred embodiment of broadband multi-loop antenna for use in a mobile communication device according to the invention.

Referring to FIG. 11, a tenth preferred embodiment of the invention is shown. The conductor comprises a first loop 10, a second loop 20, a third loop 30, and a fourth loop 40. The tenth embodiment is identical to the ninth embodiment, except that there are only three grounding points 2, 3 and 8 in which grounding point 8 is common to the third and fourth loops 30 and 40, the third loop 30 does not have any conductive branch, and each of the first, second and fourth loops 10, 20 and 40 has a conductive branch 12, 22, or 42.

Figure 12A:
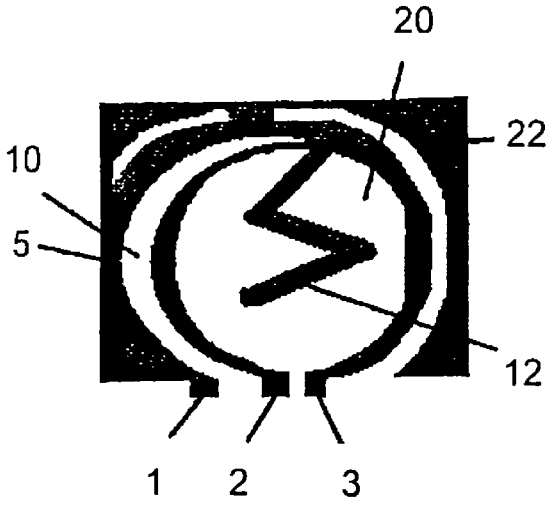
FIG. 12A is a first configuration of the antenna of FIG. 2A where the conductor forming the loop is a curve and the conductive branch of the loop is zigzag.
Figure 12B:
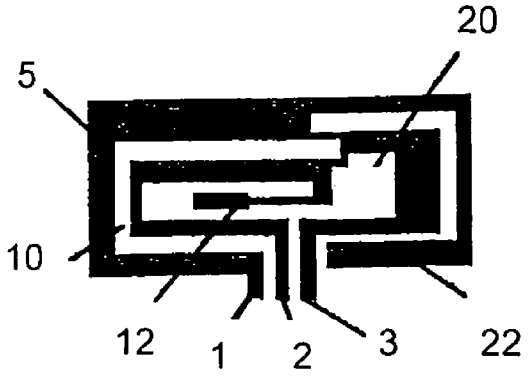
FIG. 12B is a second configuration of the antenna of FIG. 2A where the conductors forming the loop and the conductive branch are lines having an increased width.
Figure 12C:
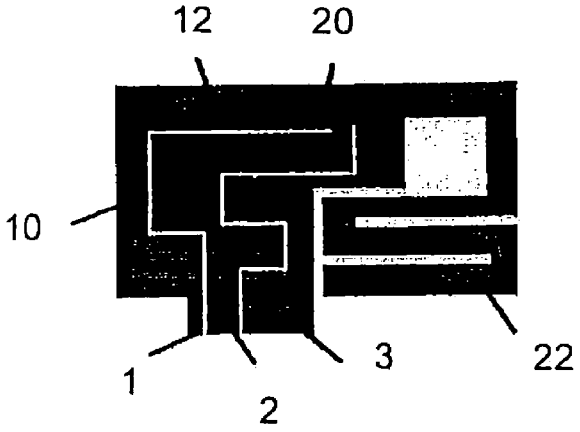
FIG. 12C is a third configuration of the antenna of FIG. 2A where the loop is formed by forming a groove on the conductor.

In each of the above embodiments, each loop including its conductive branch can be a zigzag line, a curve line, a tooth-shaped line, a line having width gradually increased, a hollow line, or the like. For example, FIG. 12A shows a first configuration of the antenna of FIG. 2A in which the first loop 10 including its conductive branch 12 is zigzag. In FIG. 12B, the second loop 20 including its conductive branch 22 is a line having a gradually increased width. In FIG. 12C, the second loop 20 is formed by forming a groove on the conductor.

For the antenna of the invention mounted on the chassis 100 of the mobile communication device, location relationship of the antenna with respect to the chassis 100 and ground plane of the chassis 100 both affect the band features of the antenna.

Figure 13:
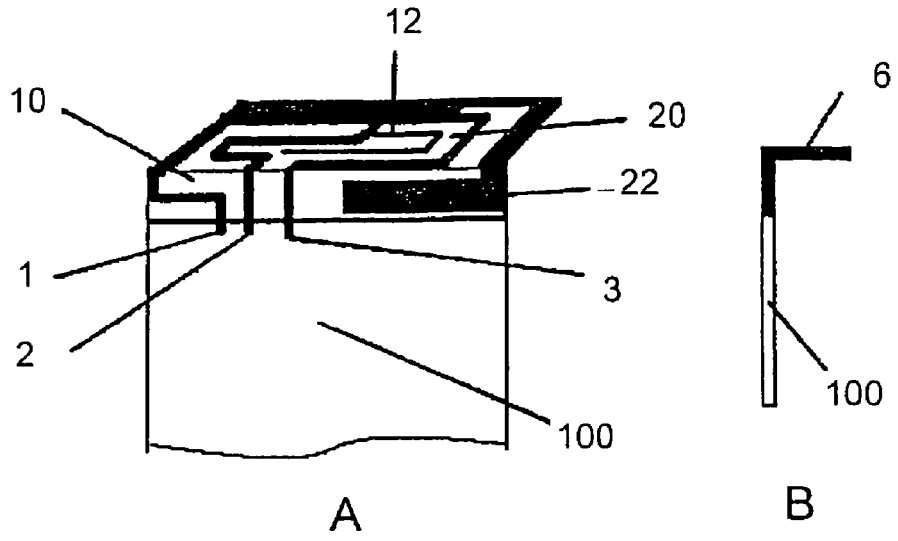
FIG. 13 is a first schematic view of the antenna according to the invention mounted on a chassis of a mobile communication device where projection of the antenna is completely out of that of the chassis.

FIG. 13 shows a first schematic view of the antenna according to the invention mounted on a chassis 100 of a mobile communication device (e.g., cellular phone) and electrically connected thereto. A projection of the antenna relative to a normal of the chassis 100 (i.e., a direction perpendicular to the plane of the chassis 100) is completely out of the projection of the chassis 100. Part A of FIG. 13 shows in perspective the antenna mounted on the chassis 100 and part B thereof shows in elevation of the same.

Figure 14:
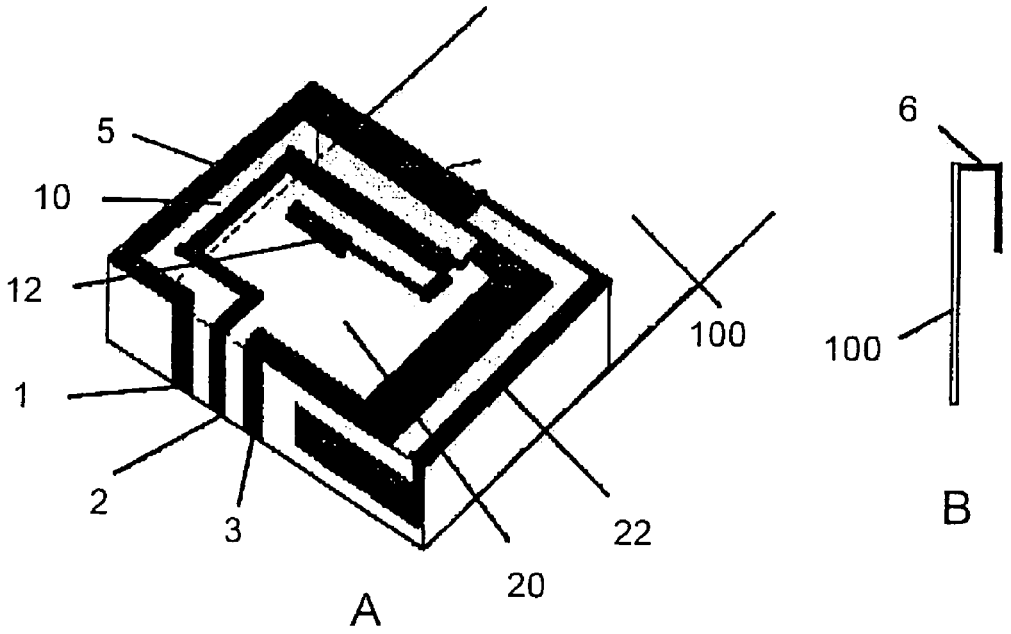
FIG. 14 is a second schematic view of the antenna according to the invention mounted on a chassis of a mobile communication device where projection of the antenna is completely within that of the chassis.

FIG. 14 shows a second schematic view of the antenna according to the invention mounted on a chassis 100 of a mobile communication device (e.g., cellular phone) and electrically connected thereto. A projection of the antenna relative to a normal of the chassis 100 is completely within the projection of the chassis 100. Part A of FIG. 14 shows in perspective the antenna mounted on the chassis 100 and part B thereof shows in elevation of the same.

Figure 15A:
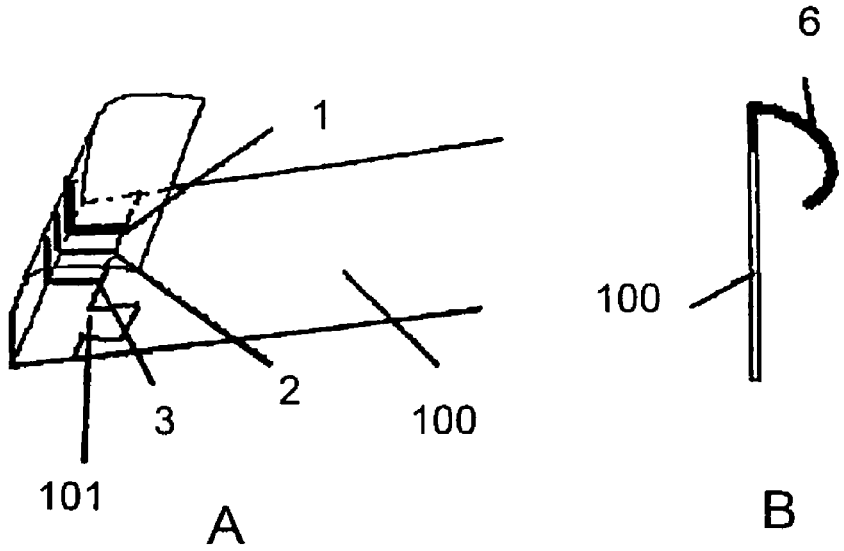
FIG. 15A is a third schematic view of the antenna according to the invention mounted on a chassis of a mobile communication device where a portion of projection of the antenna is within that of the chassis, another portion thereof is out of the projection of the chassis, and there is a gap on a ground plane of the chassis.

FIG. 15A shows a third schematic view of the antenna according to the invention mounted on a chassis 100 of a mobile communication device (e.g., cellular phone) and electrically connected thereto. A portion of projection of the antenna relative to a normal of the chassis 100 is within the projection of the chassis 100, another portion thereof is out of the projection of the chassis 100, and there is a recess 101 on a ground plane of the chassis 100 at the superposition portion of the antenna and the chassis 100. Part A of FIG. 15A shows in perspective the antenna mounted on the chassis 100 and part B thereof shows in elevation of the same.

Figure 15B:
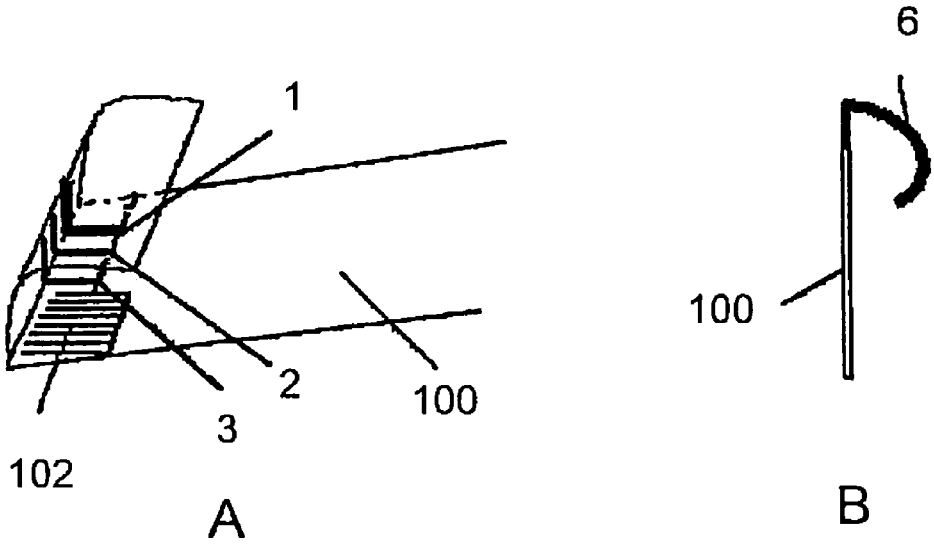
FIG. 15B is a view similar to FIG.

FIG. 15B shows a fourth schematic view of the antenna according to the invention mounted on a chassis 100 of a mobile communication device (e.g., cellular phone) and electrically connected thereto. Similar to the structure shown in FIG. 15A, a portion of projection of the antenna relative to a normal of the chassis 100 is within the projection of the chassis 100, another portion thereof is out of the projection of the chassis 100, and there is a recess 101 on a ground plane of the chassis 100. Part A of FIG. 15B shows in perspective the antenna mounted on the chassis 100 and part B thereof shows in elevation of the same. The only difference is that a grid structure 102 is formed at the ground plane of the chassis 100.

Figure 16A:
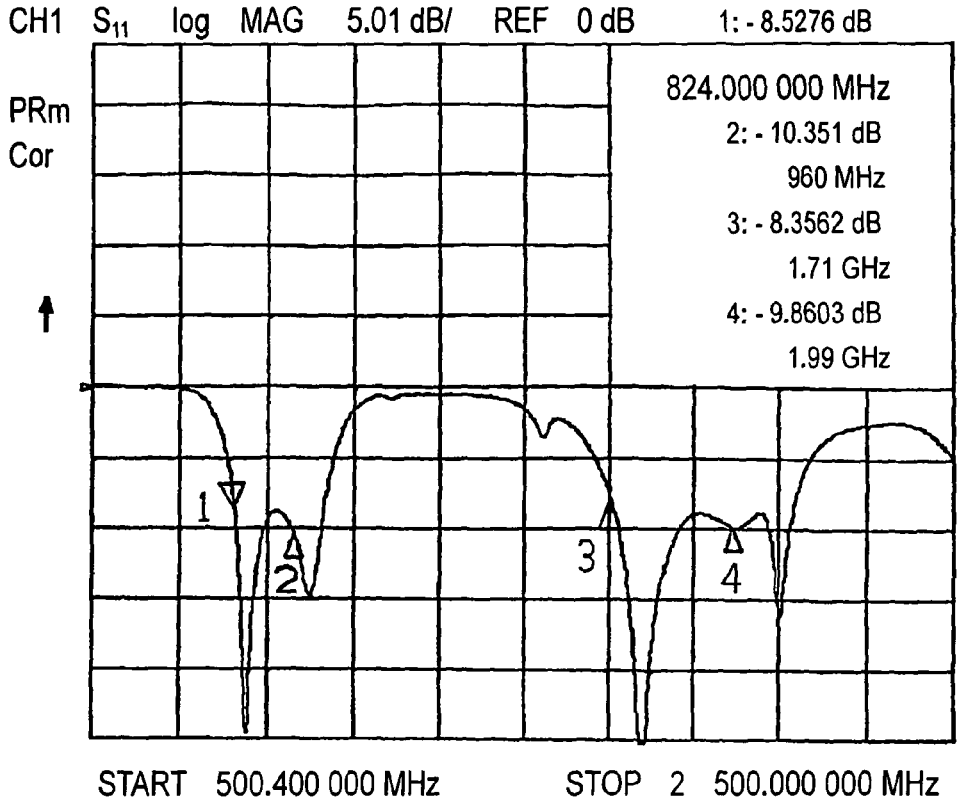
FIG. 16A is a graph showing a curve drawn by testing the antenna of the invention in a first application.

Referring to FIG. 16A, it is a graph showing a curve drawn by testing the antenna of the invention in a first application in which the antenna is capable of operating in one of five bands including GSM 800 Hz, GSM 900 Hz, GSM 1800 Hz, GSM 1900 Hz, and UMTS.

Figure 16B:
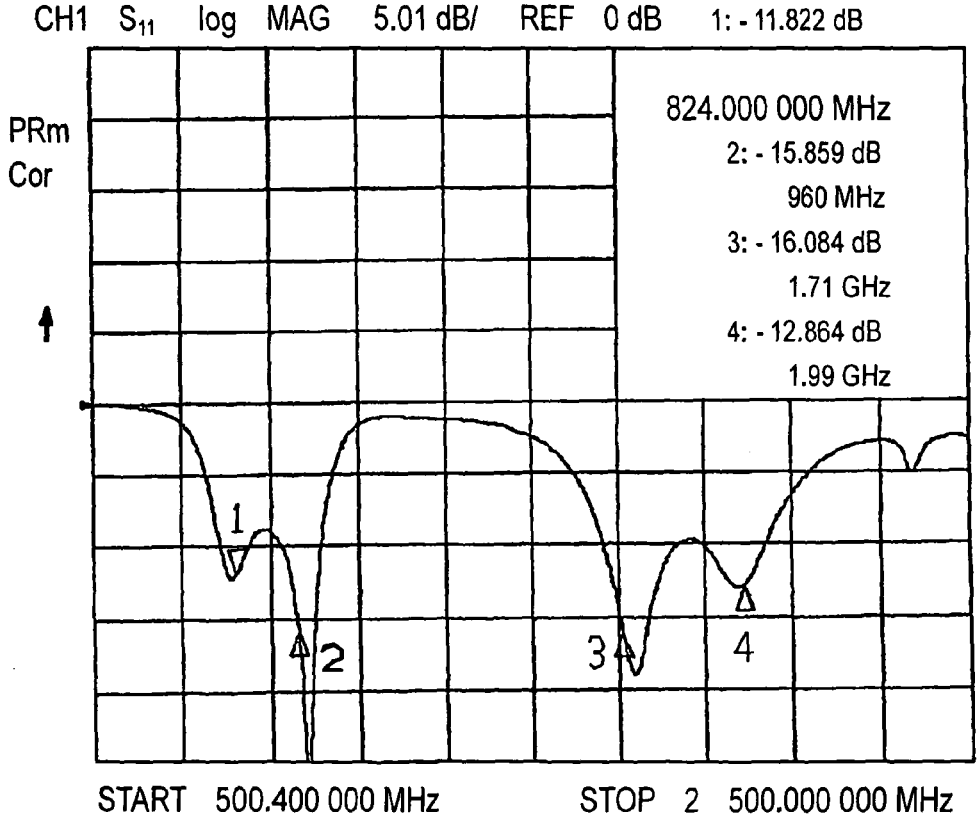
FIG. 16B is a graph showing a curve drawn by testing the antenna of the invention in a second application.

Referring to FIG. 16B, it is a graph showing a curve drawn by testing the antenna of the invention in a second application in which the antenna is capable of operating in one of four bands including GSM 850 Hz, GSM 900 Hz, GSM 1800 Hz, and GSM 1900 Hz.

While the invention herein disclosed has been described by means of specific embodiments, numerous modifications and variations could be made thereto by those skilled in the art without departing from the scope and spirit of the invention set forth in the claims.

What is claimed is:

1. A broadband multi-loop antenna mountable in a mobile communication device having a chassis, comprising:

a conductor assembly electrically connected to the chassis and including a plurality of loops each starting at a common feed point and ending at respective grounding points; and means for mounting the conductor assembly thereon, wherein at least one of the loops comprises at least one conductive branch having one end connected to a predetermined location of the loop other than the grounding point of the loop and the other end open; and wherein the loops comprise a first loop having a grounding point, and a second loop having a grounding point, the first and second loops having a common conductor, and either (i) the first and second loops being located on the same side of the common conductor or (ii) the grounding point of the first loop and the grounding point of the second loop being located on the same side of the common feed point.

2. The broadband multi-loop antenna of claim 1, further comprising a third loop, and wherein the first, the second, and the third loops have the common conductor.

3. The broadband multi-loop antenna of claim 2, wherein the first loop comprises a conductive branch, the second loop comprises a conductive branch, and the third loop comprises a conductive branch, wherein each of the conductive branches has a length in a range of about 0.1 mm to about 80 mm, wherein a length from a connecting point of the conductive branch and the first loop to an end of the feed point is about 10% to 90% of a total length of the first loop, wherein a length from a connecting point of the conductive branch and the second loop to an end of the feed point is about 10% to 90% of a total length of the second loop, and wherein a length from a connecting point of the conductive branch and the third loop to an end of the feed point is about 10% to 90% of a total length of the third loop.

4. The broadband multi-loop antenna of claim 2, wherein at least one of the first, the second, and the third loops comprises two conductive branches, wherein at least one of the first, the second, and the third loops comprises a conductive branch, wherein each of the conductive branches has a length in a range of about 0.1 mm to about 80 mm, wherein a length from a connecting point of the conductive branch and each of the first, the second, and the third loops to an end of the feed point is about 10% to 90% of a total length of each of the first, the second, and the third loops.

5. The broadband multi-loop antenna of claim 2, further comprising a first conductive connection for interconnecting portions of the first loop and the second loop other than the common conductor, and a second conductive connection for interconnecting portions of the second loop and the third loop other than the common conductor.

6. The broadband multi-loop antenna of claim 2, further comprising a first conductive connection for interconnecting the first loop and the second loop, and a second conductive connection for interconnecting the second loop and the third loop.

7. The broadband multi-loop antenna of claim 1, wherein the first loop comprises at least one conductive branch and the second loop comprises at least one conductive branch, wherein each of the conductive branches has a length in a range of about 0.1 mm to about 80 mm, wherein a length from a connecting point of the conductive branch and the first loop to an end of the feed point is about 10% to 90% of a total length of the first loop, and wherein a length from a connecting point of the conductive branch and the second loop to an end of the feed point is about 10% to 90% of a total length of the second loop.

8. The broadband multi-loop antenna of claim 1, further comprising a conductive connection for interconnecting portions of the first loop and the second loop other than the common conductor.

9. The broadband multi-loop antenna of claim 1, further comprising a conductive connection for interconnecting the first loop and the second loop.

10. The broadband multi-loop antenna of claim 1, wherein the loops comprise the first loop, the second loop, a third loop, and a fourth loop, and wherein each of the first, the second, the third, and the fourth loops has a grounding point and a conductive branch.

11. The broadband multi-loop antenna of claim 1, wherein the loops comprise the first loop, the second loop, a third loop, and a fourth loop, wherein each of the first and the second loops has a common grounding point, and wherein each of the first, the second, and the fourth loops has a conductive branch.

12. The broadband multi-loop antenna of claim 1, wherein a projection of the antenna relative to a normal of the chassis is completely outside the projection of the chassis.

13. The broadband multi-loop antenna of claim 1, wherein a projection of the antenna relative to a normal of the chassis is completely within the projection of the chassis, and further comprising a recess on a ground plane of the chassis at the projection superposition portion of the antenna and the chassis.

14. The broadband multi-loop antenna of claim 1, wherein a projection of the antenna relative to a normal of the chassis is partially within the projection of the chassis, and further comprising a recess on a ground plane of the chassis at the projection superposition portion of the antenna and the chassis.

* * * * *